US008317066B1

(12) United States Patent
Meyer et al.

(10) Patent No.: US 8,317,066 B1
(45) Date of Patent: Nov. 27, 2012

(54) BOW TYING APPARATUS AND METHOD OF USE

(76) Inventors: Molly P. Meyer, San Antonio, TX (US); Robert L. Acker, San Antonio, TX (US)

( * ) Notice: Subject to any disclaimer, the term of this patent is extended or adjusted under 35 U.S.C. 154(b) by 354 days.

(21) Appl. No.: 12/701,820

(22) Filed: Feb. 8, 2010

(51) Int. Cl.
*A41H 43/00* (2006.01)

(52) U.S. Cl. ..... 223/46

(58) Field of Classification Search ..... 223/44, 223/46; 428/4, 5; 28/147, 149, 150
See application file for complete search history.

(56) References Cited

U.S. PATENT DOCUMENTS

| | | | | |
|---|---|---|---|---|
| 2,966,759 | A * | 1/1961 | Robertson | 38/102.1 |
| 3,073,307 | A * | 1/1963 | Stevens | 604/192 |
| 3,229,870 | A * | 1/1966 | Capstick | 223/46 |
| 3,300,107 | A * | 1/1967 | Koch | 223/46 |
| 3,411,677 | A * | 11/1968 | Bickner | 223/46 |
| 3,587,946 | A * | 6/1971 | Christensen | 223/46 |
| 3,850,293 | A | 11/1974 | Scaringi | |
| 4,629,100 | A | 12/1986 | Owens | |
| D291,841 | S | 9/1987 | Owens | |
| 5,094,370 | A | 3/1992 | Specht | |
| 5,411,188 | A | 5/1995 | Teuten | |
| D389,998 | S | 2/1998 | Cavender et al. | |
| 5,810,214 | A | 9/1998 | Hecht | |
| 6,000,586 | A | 12/1999 | Cavender | |
| 6,131,778 | A | 10/2000 | Etzion | |

* cited by examiner

*Primary Examiner* — Shelley Self
*Assistant Examiner* — Andrew Sutton
(74) *Attorney, Agent, or Firm* — Montgomery Patent & Design, LLC; Robert C. Montgomery; Joseph Yaksich

(57) ABSTRACT

An apparatus and method of use for making a decorative bow is herein disclosed, comprising a removable lance used to retain a length of bow making material about a central location. The lance prevents each winded loop from coming apart during the bow making process. The apparatus is provided with a plurality of pairs of removable support rods, each pair having different lengths to accommodate varying widths of bow making material. In a preferred embodiment, the apparatus provides guide indicia to indicate suggested bow making directions and a support rod to hold a spool of bow making material during manufacture. A non-slip covering is provided thereon the base to prevent the apparatus from moving during use.

2 Claims, 5 Drawing Sheets

BOW TYING APPARATUS AND METHOD OF USE

RELATED APPLICATIONS

The present invention was first described in a notarized Official Record of Invention on Dec. 16, 2008, that is on file at the offices of Montgomery Patent and Design, LLC, the entire disclosures of which are incorporated herein by reference.

FIELD OF THE INVENTION

The present invention relates generally to bow making apparatus, and more particularly, to an apparatus and method for making decorative bows made of ribbon.

BACKGROUND OF THE INVENTION

Bow making is a time honored craft that dates back many generations. Handmade bows can be used for decorating packages in their small sizes, while larger ones can be used to decorate buildings and other large objects. It is common for such bows to be made by hand using simple jig-based machines that allows a user to wrap ribbon or similar fabric material around movable dowel rods. Hand crafting allows a bow maker to produce original and creative bow designs in a manner which is lost using complex automated bow making machines.

While traditional hand crafting bow making processes work, they typically require the bow maker to secure the ribbon in place around a central post for the entire bow making process. If the ribbon should be let go, the entire bow may simply fall apart forcing the user to start over. This is a detrimental factor in an otherwise enjoyable craft. Various attempts have been made to provide hand made bow making apparatus. Examples of such attempts can be seen in several U.S. patents: U.S. Pat. No. 3,850,293, issued in the name of Scaringi, describing a bow making kit; U.S. Pat. No. 4,629,100, issued in the name of Owens, describing an apparatus for tying bows; U.S. Pat. No. 5,094,370, describing a method and fixture for center-loop bow making; U.S. Pat. No. 5,411,188, issued in the name of Teuten, describing an adjustable frame bow making device; U.S. Pat. No. 5,810,214, issued in the name of Hecht, describing a method and device for bow making; U.S. Pat. No. 6,000,586, issued in the name of Cavender, describing a bow making apparatus; and, U.S. Pat. No. 6,131,778, issued in the name of Etzion, describing a bow maker with ribbon securing element.

Additionally, various designs exist for bow making devices. Examples of such designs can be seen in U.S. Pat. No. D 291,841, issued in the name of Owens and U.S. Pat. No. D 389,998, issued in the name of Cavender et al.

The disclosures of these examples are incorporated herein by reference. While these attempts may fulfill their respective, particular objectives, each suffers from one (1) or more disadvantages or deficiencies. Accordingly, there is a need for a means by which decorative bows of various sizes can be made without the disadvantages of conventional bow making jigs. The development of the present invention substantially departs from the conventional solutions and in doing so fulfills this need.

SUMMARY OF THE INVENTION

In view of the foregoing prior art references, the inventor recognized inherent problems in devices intended to manufacture decorative bows by hand and observed that there is a need for an apparatus which provides bow makers a means and method to hand craft their own original bows in various sizes in a manner which is effective and thus, the object of the present invention is to solve the aforementioned disadvantages and provide for this need.

Another object of the present invention is to provide a bow tying apparatus which is modular and simple to use and allows a bow maker to make original bows from approximately two inches in diameter up to approximately fourteen inches in diameter.

Another object of the present invention is to provide an apparatus which enables bow makers to utilize bow making material of various widths to manufacture narrow ribbon bows and wide ribbon bows.

Another object of the present invention is to provide an integral storage area for all components of the apparatus, thus making storage convenient.

Another object of the present invention is to provide clear bow making instructional guides integral to a work surface.

Another object of the present invention is to provide an apparatus which is durable, lightweight, and simple and cost effective to manufacture.

To achieve these objectives and advantages, the present invention provides a bow tying apparatus having a generally rectangular main body which provides a work surface for receiving and retaining a continuous length of bow making materials. This bow making material can either be of a preselected length or be deployed from a spool of bow making material. One (1) embodiment of the apparatus provides a plurality of apertures on a face of the main body, into which a pointed lance and a pair of rods are inserted. The apparatus includes a plurality of lances and pairs of rods having varying lengths to accommodate various widths of bow making material. The lance is set in a main lance aperture having a central position in relation to a plurality of pairs of rod apertures disposed at incremental distances on both sides of the main lance aperture. The pair of rods is set in a selected pair of rod apertures each at a desired preselected distance from the lance. This preselected distance is equivalent to the desired diameter of a manufactured bow. A first end of the continuous length of bow making material is retained to the work surface by piercing with the lance, while the remaining length of bow making material is wound around the pair of rods forming a plurality of bow loops. Each time the continuous length of bow making material passes over the lance, it is pierced by the lance thus retaining a base portion of each loop.

Furthermore, the described features and advantages of the invention may be combined in various manners and embodiments as one skilled in the relevant art will recognize. The invention can be practiced without one or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
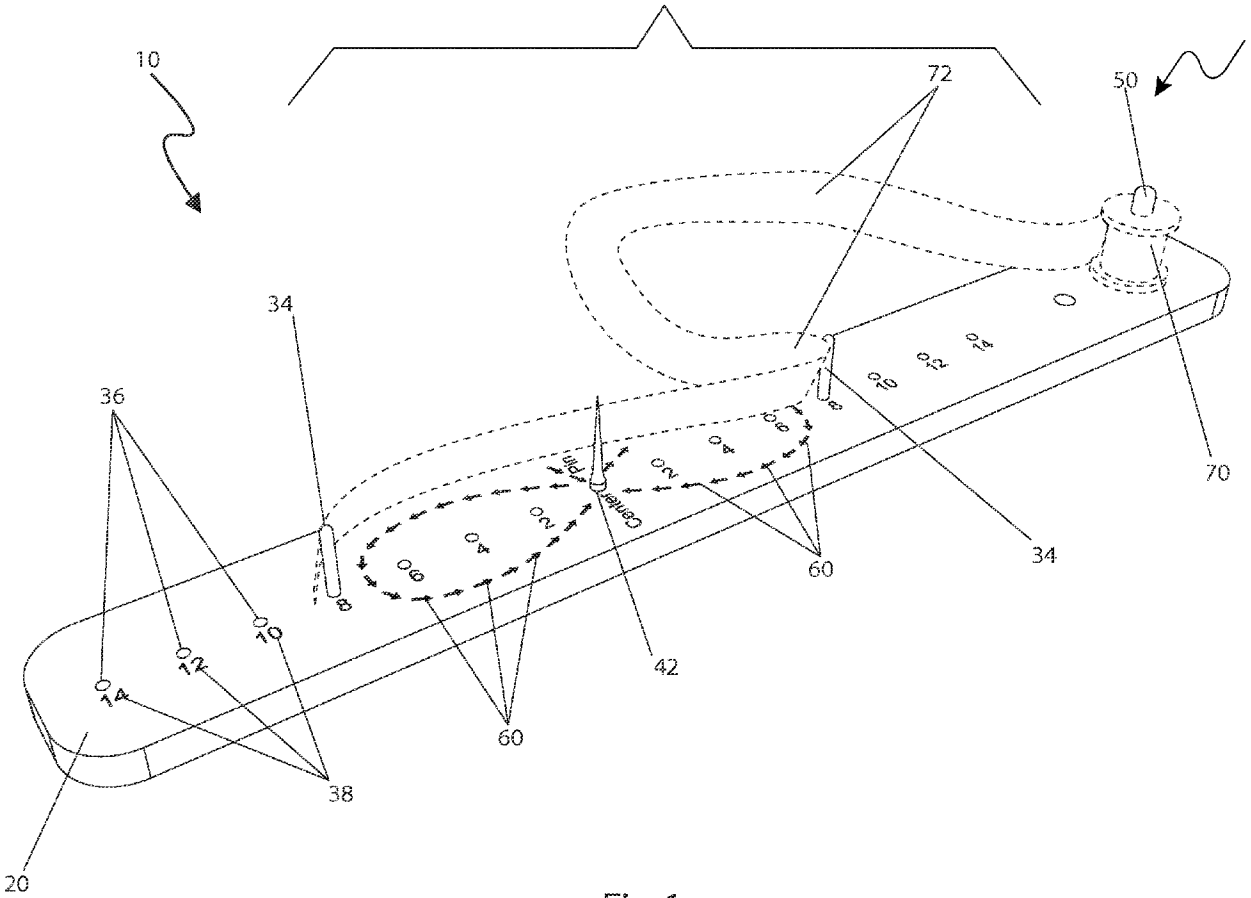
FIG. 1 is an environmental view of a bow tying apparatus 10, according to a preferred embodiment of the present invention.

| | |
|---|---|
| 10 | bow tying apparatus |
| 20 | face portion |
| 22 | top portion |
| 24 | rear portion |
| 26 | high friction surface |
| 30 | first rod |
| 31 | first rod aperture |
| 32 | second rod |
| 33 | second rod aperture |
| 34 | third rod |
| 35 | third rod aperture |
| 36 | rod aperture |
| 38 | width indicia |
| 40 | first lance |
| 41 | first lance aperture |
| 42 | second lance |
| 43 | second lance aperture |
| 44 | sheath |
| 45 | sheath aperture |
| 46 | sheath body |
| 47 | sheath center aperture |
| 48 | main lance aperture |
| 49 | lance indicia |
| 50 | spool rod |
| 51 | spool rod aperture |
| 52 | first spool aperture |
| 54 | second spool aperture |
| 56 | spool indicia |
| 60 | directional indicia |
| 62 | start indicia |
| 64 | finish indicia |
| 70 | spool |
| 72 | ribbon |

DETAILED DESCRIPTION OF THE PREFERRED EMBODIMENT

The best mode for carrying out the invention is presented in terms of its preferred embodiment, herein depicted within FIGS. 1 through 5B. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a bow tying apparatus and method of use (herein described as the "apparatus") 10, which provides a means for creating decorative bows. The apparatus 10 comprises a main structure, a plurality of rods 30, 32, 34, a plurality of rod apertures 31, 33, 35, a first lance 40, a second lance 42, and a multiplicity of indicia. The apparatus 10 allows a user to create various sized bows from conventional spools of ribbon 72 in a secure manner.

Referring now to FIG. 1, an environmental view of the apparatus 10, according to the preferred embodiment of the present invention, is disclosed. The apparatus 10 comprises an elongated main body measuring preferably twenty-one-and-a-half (21½) inches in length by a half (½) inch in height. The main structure comprises a face portion 20 providing a main work area for a user. The face portion 20 is further comprised of a plurality of rod apertures 36 enabling insertion of a plurality of rods 30, 32, 34 and a plurality of width indicia 38 enabling an approximate measurement for the width of a bow. The face portion 20 further comprises a section for the placement of a spool 70, thereby enabling ribbon 72 to be secured onto the apparatus 10 during use. The apparatus 10 is fabricated from materials such as, but not limited to: plastic, wood, or the like in well-known processes such as wood shaping and finishing as well as plastic injection molding.

Figure 2:
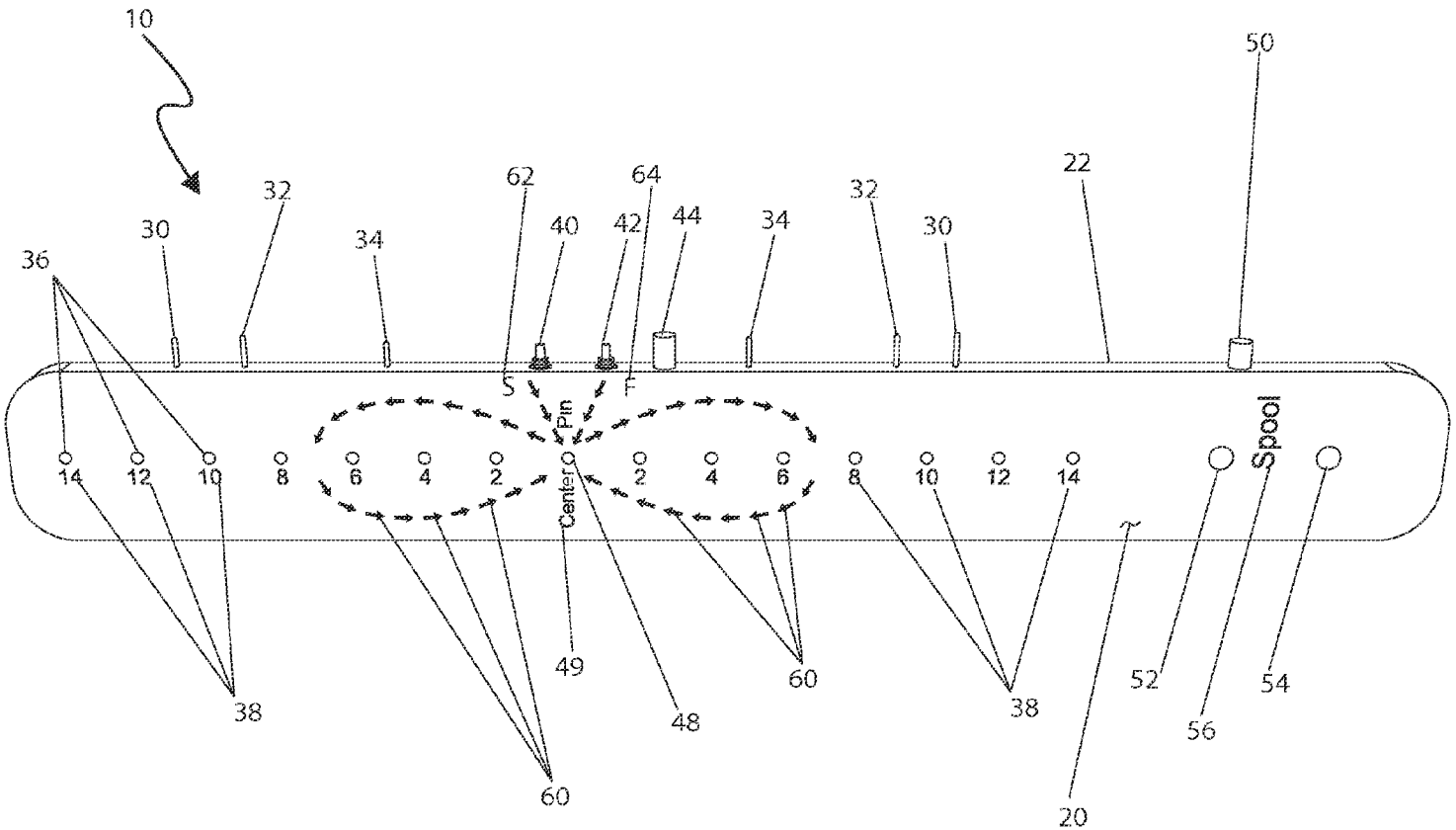
FIG. 2 is a front perspective view of the bow tying apparatus 10, according to a preferred embodiment of the present invention.
Figure 3:
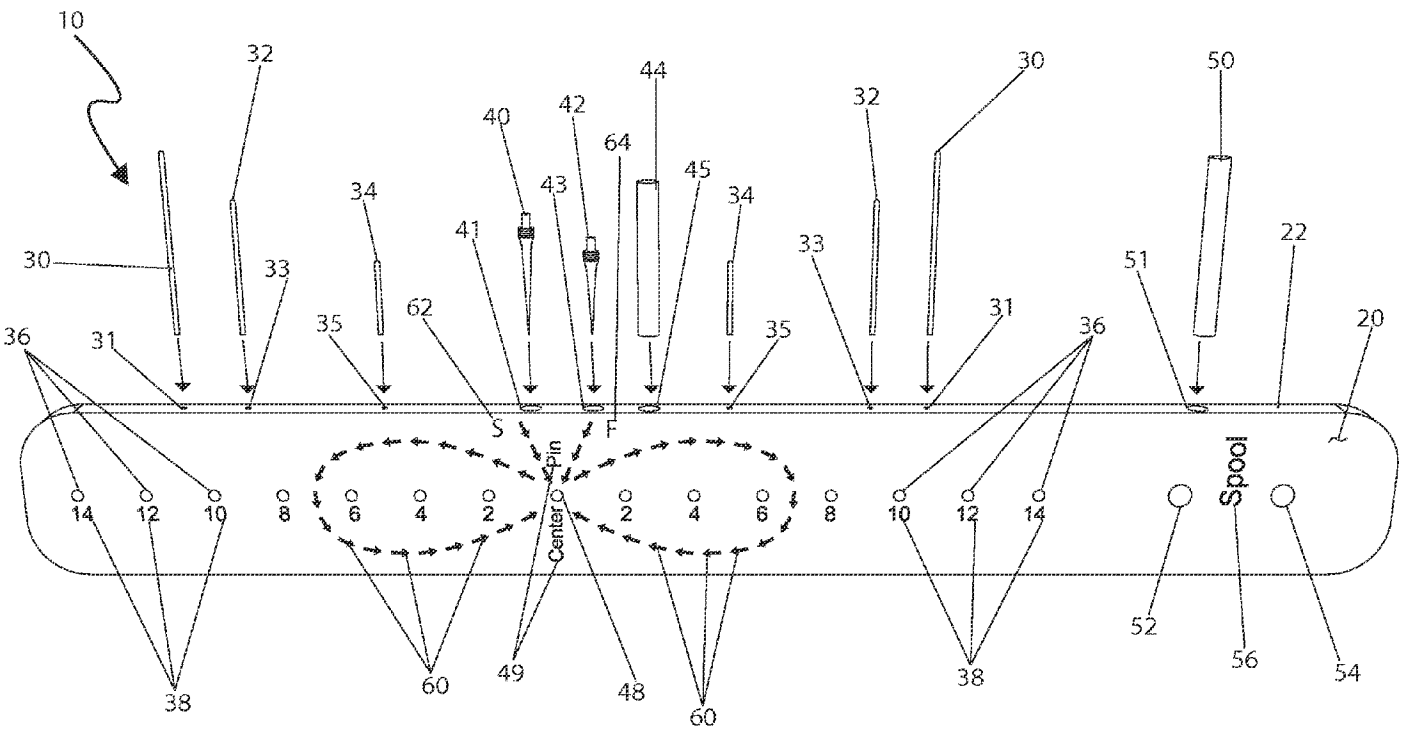
FIG. 3 is an exploded view of the bow tying apparatus 10, according to a preferred embodiment of the present invention.

Referring now to FIG. 2, a front perspective view of the apparatus 10 and FIG. 3, an exploded view of the apparatus 10, according to the preferred embodiment of the present invention, are disclosed. The apparatus 10 comprises a pair of first rods 30, a pair of second rods 32, a pair of third rods 34, a plurality of rod apertures 36, a plurality of width indicia 38, a first lance 40, a first lance aperture 41, a second lance 42, a second lance aperture 43, a sheath 44, a sheath aperture 45, lance indicia 49, a spool rod 50, a spool rod aperture 51, a first spool aperture 52, a second spool aperture 54, spool indicia 54, a main lance aperture 48, directional indicia 60, start indicia 62, and finish indicia 64.

A top portion 22 of the apparatus 10 is utilized for storage of the pair of first rods 30, the pair of second rods 32, the pair of third rods 34, the first lance 40, the second lance 42, the sheath 44, and the spool rod 50, thereby supplying each with a corresponding aperture 31, 33, 35, 41, 43, 45, 51. The apertures 31, 33, 35, 41, 43, 45, 51 are drilled to appropriate depths to receive each corresponding item. The apparatus 10 also comprises a plurality of rod apertures 36 and a main lance aperture 48 providing a secure in-use placement for the rods 30, 32, 34 and the lances 40, 42, respectively. A desired pair of rods 30, 32, 34 are inserted therein an appropriate rod aperture 36, thereby enabling the user to create various sized bows. The rod apertures 36 are located at an intermediate position thereon the face portion 20. The rod apertures 36 are also labeled with width indicia 38 which correspond to the width of the bow to be manufactured. The width indicia 38 preferably comprise descending and ascending digits corresponding to the width. The width ranges from two (2) inches to fourteen (14) inches.

The diameter of the pair of first rods 30, the diameter of the pair of second rods 32, and the diameter of the pair of third rods 34 are equivalent, thereby allowing any rod 30, 32, 34 to be inserted thereinto any rod aperture 36. The lengths of the rods 30, 32, 34 differ, thereby fitting a variety of sized bows. The first rod 30 is approximately three-and-a-half (3½) inches in length, the second rod 32 is approximately two-and-a-half (2½) inches in length, and the third rod 34 is approximately one-and-a-half (1½) inches in length. Each rod 30, 32, 34 is preferably fabricated from a material such as, but not limited to: wood, plastic, or the like.

The apparatus 10 comprises a first lance 40 and a second lance 42 enabling a user to impale the ribbon 72 securely in place to prevent the bow from separating during manufacturing. The first lance 40 is approximately three (3) inches in length and the second lance 42 is approximately two (2) inches in length. The first lance 40 is utilized for the manufacturing of large bows and the second lance 42 is utilized for the manufacturing of small bows. A top portion of the lances 40, 42 comprises a threaded area enabling a secure insertion into the threaded main lance aperture 48 located thereon the face portion 20 of the apparatus 10. The main lance aperture 48 is an appropriate diameter to allow insertion of the lances 40, 42. The main lance aperture 48 is also labeled with lance indicia 49 to clearly communicate to the user where to insert the lance 40, 42. The lance indicia 49 preferably comprise words or images to communicate proper placement of the lance 40, 42 such as, but not limited to: LANCE, CENTER PIN, or the like. A bottom portion of each lance 40, 42 comprises a sharp point to skewer the ribbon 72. The lances 40, 42 are fabricated from materials such as, but not limited to: metal, plastic, or the like. To protect the user from a sharp end portion thereon a tip of each lance 40, 42 a sheath 44 is provided (see FIGS. 5A and 5B). The sheath 44 is stored on the top portion 22 therein a sheath aperture 45.

The apparatus 10 also comprises a spool rod 50 for securing a spool 70 of ribbon 72 thereto the face portion 20. The spool rod 50 is comprises of a tubular rod stored on the top portion 22 therein a spool rod aperture 51. The spool rod aperture 51 comprises an appropriate diameter that corresponds to the diameter of the spool rod 50. When the apparatus 10 is in-use the spool rod 50 is inserted into a first spool rod aperture 52 or a second spool rod aperture 54 depending on the size of the spool 70 and size of bow desired. The user preferably places a spool 70 on the face portion 22, superjacent to the spool rod apertures 52, 54 and slidably inserts the spool rod 50 into the spool 70 and spool rod aperture 52, 54, thereby securing the spool to the apparatus 10. Spool indicia 56 are also located thereon the face portion 22 allowing a user to clearly position a spool 70 in an appropriate location. The spool indicia 56 preferably comprise words or images pertaining to bow making such as, but not limited to: SPOOL, RIBBON, or the like. The spool rod 50 is approximately three-and-a-half (3½) inches in length and fabricated from materials similar to the abovementioned rods 30, 32, 34.

The apparatus 10 further comprises indicia to communicate proper bow making procedures to the user. The indicia are located on the face portion 20 and centered around the rod apertures 36 and width indicia 38. The indicia comprises start indicia 62 for showing a user where to begin the tail of the ribbon 72. The start indicia 62 preferably comprises words, letters, or images pertaining to the start of manufacturing a bow such as, but not limited to: "S", START, BEGIN, or the like. The indicia also comprise finish indicia 64 for communicating to the user where to stop the ribbon 72. The finish indicia 64 preferably comprises words, letters, or images pertaining to the end of manufacturing a bow such as, but not limited to: "F", STOP, FINISH, or the like. The indicia further comprise directional indicia 60 for communicating to the user the proper path to follow for manufacturing a bow. The directional indicia 60 begin at the start indicia 62 and follow a figure-eight (8) path ending at the finish indicia 64. The directional indicia 60 is preferably arrows, dashed lines, or the like which clearly show the appropriate path the user should follow.

Figure 4:
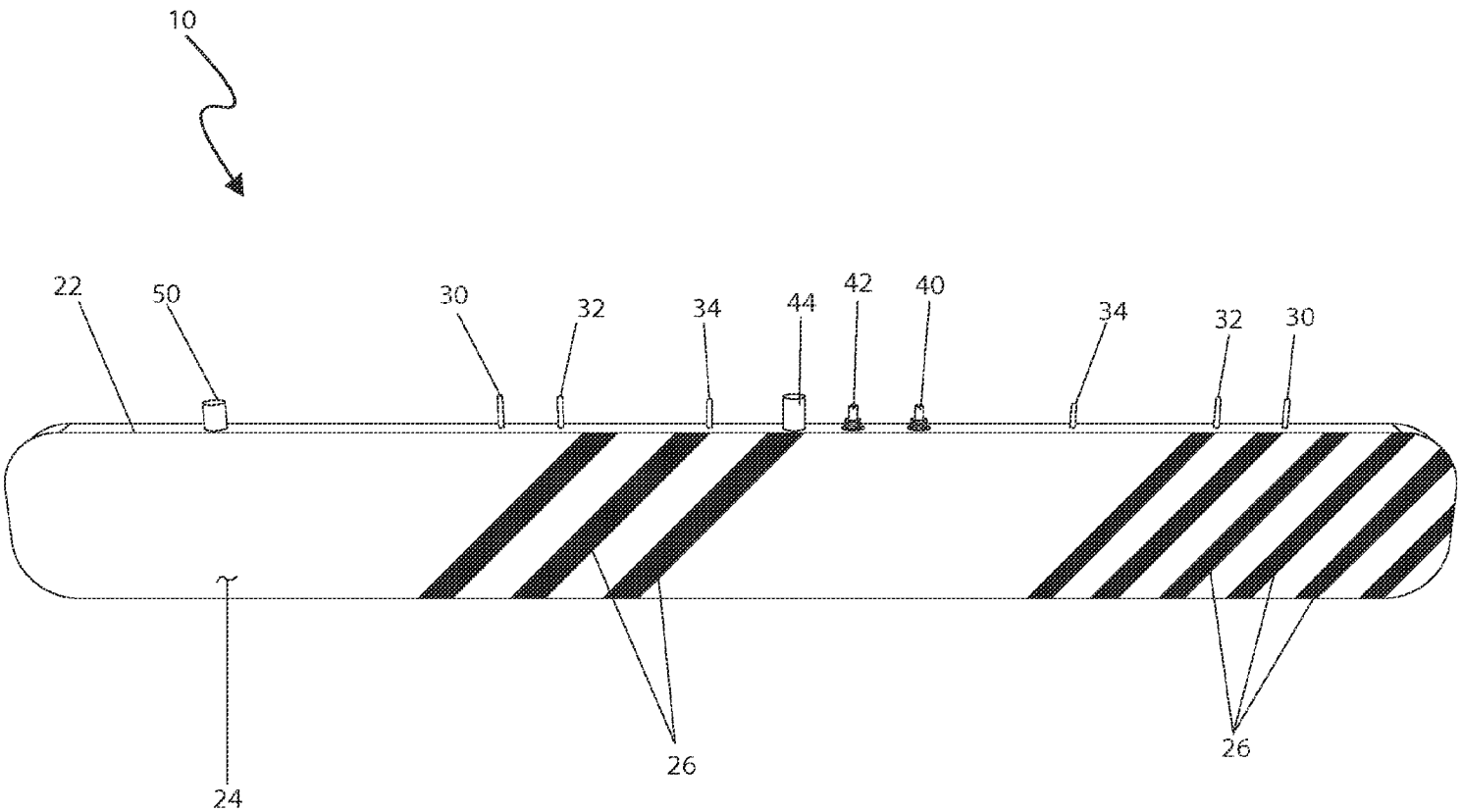
FIG. 4 is a rear view of the bow tying apparatus 10, according to a preferred embodiment of the present invention.

Referring now to FIG. 4, a rear view of the apparatus 10, according to the preferred embodiment of the present invention, is disclosed. A rear portion 24 of the apparatus 10 comprises a high friction surface 26 for stabilizing the apparatus 10 on a working surface such as, but not limited to: a table top, a user's lap, or the like. Said high friction surface 26 is located either on the entire rear portion 24 or crucial regions on the rear portion 24. The high friction surface 26 is preferably comprised of non-slip materials such as, but not limited to: rubber, adhesive, fasteners, or the like.

Figure 5B:
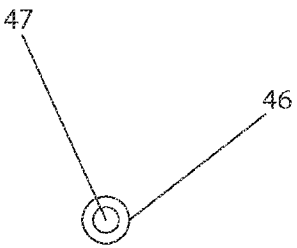
FIG. 5A is a side view of a sheath 44, according to a preferred embodiment of the present invention; and, FIG. 5B is a bottom view of the sheath 44, according to a preferred embodiment of the present invention.
Figure 5A:
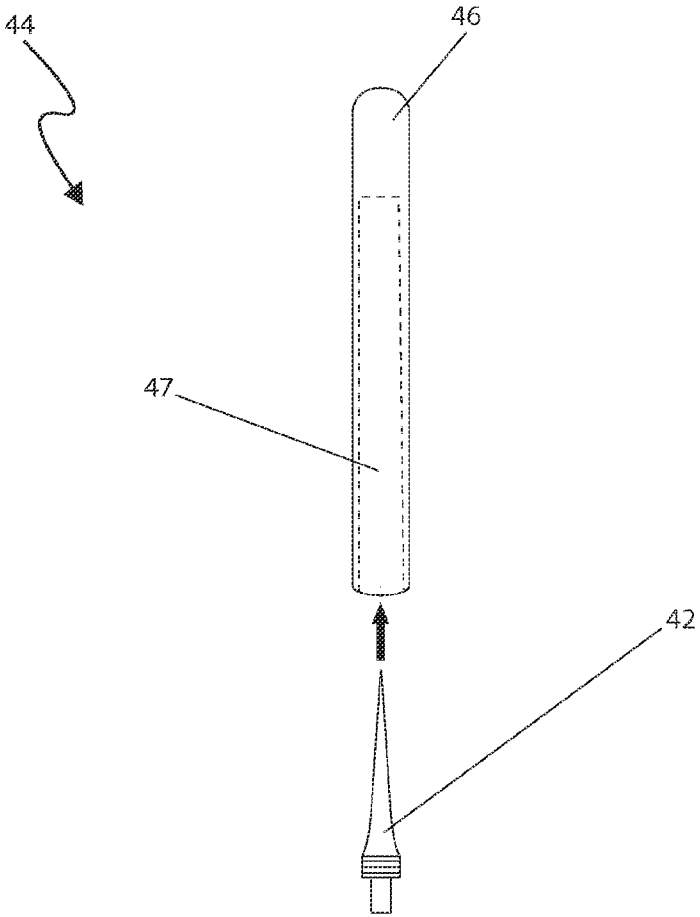

Referring now to FIG. 5A, a side view of the sheath 44 and FIG. 5B, a bottom view of the sheath 44, according to the preferred embodiment of the present invention, are disclosed. FIG. 5A depicts the second lance 42 for illustration purposes only; it is known that either the first lance 40 or second lance 42 may be utilized in the same manner. The apparatus 10 comprises a sheath 44 for providing a protective covering to the lances 40, 42 when they are not in use to protect the user from the sharp end portions of the lances 40, 42. The sheath 44 comprises a tubular sheath body 46 which further comprises a sheath center aperture 47 enabling the insertion of the lance 40, 42. The sheath center aperture 47 extends thereinto the sheath body a maximum depth of the length of the first lance 40 allowing either lance 40, 42 to fit thereinside. The sheath 44 is stored thereon the top portion 22 of the apparatus 10 therein the sheath aperture 45 (see FIG. 2). The sheath 44 is preferably fabricated from a similar material as the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 through 5B.

The method of installing and utilizing the apparatus 10 may be achieved by performing the following steps: acquiring the apparatus 10; determining the width of bow to create and utilizing an appropriate sized rod 30, 32, 34; removing a desired rod 30, 32, 34 from the top portion 22; inserting the rod 30, 32, 34 into a rod aperture 36 which corresponds to an appropriate width indicia 38 needed to create the desired size of bow; placing a spool 70 on top of a desired spool aperture 52, 54; removing the spool rod 50 from the top portion 22 and inserting it thereinto the spool 70 and spool aperture 52, 54; removing a desired lance 40, 42 and sheath 44 from the top portion 22; inserting the lance 40, 42 thereinto the sheath center aperture 47 and inserting the threaded end portion of the lance 40, 42 thereinto the main lance aperture 48; unwrapping a desired length of ribbon 72 from the spool 70; positioning the tail of the ribbon 72 at the start indicia 62, removing the sheath 44 from the lance 40, 42, and impaling the ribbon 72 through the lance 40, 42 creating a starting position; following the directional indicia 60 to create a bow; impaling the ribbon 72 in accordion fashion every time said ribbon 72 crosses the main lance aperture 48; cutting the ribbon 72 at the finish indicia 64 when a desired size of bow is created; cutting the ribbon 72 from the spool 70; securing a center portion of the bow with a desired fastening means; removing the manufactured bow from the lance 40, 42; fanning-out the loops of the bow and cutting the tails of the bow as necessary; creating additional bows as necessary and following the abovementioned steps; replacing the lance 40, 42 thereinto an appropriate lance aperture 41, 43; replacing the sheath 44 thereinto the sheath aperture 45; replacing the rod 30, 32, 34 thereinto the first rod aperture 31, second rod aperture 33, or third rod aperture 35; removing the spool rod 50 from the spool 70; replacing the spool rod 50 thereinto the spool rod aperture 51; storing the apparatus 10; and, enjoying the ease of creating decorative bows for all occasions.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A bow tying apparatus comprising:

a main body having at least a face portion for providing a work surface;

a plurality of interchangeable rods having a circular cross section for winding a continuous length of material therearound to form at least one bow loop, further comprising:

at least one pair of first rods each having a length of at least three and one half inches;

at least one pair of second rods each having a length of at least two and one half inches; and, at least one pair of third rods each having a length of at least one and one half inches;

a plurality of interchangeable lances having a circular threaded lower end and a pointed upper end for piercing through said continuous length of material for releasably retaining said continuous length of material at a base portion of each of said at least one bow loop during manufacturing, each further comprising:

a length of at least two inches;

a removable sheath having a tubular body with a closed end and an open end for receiving said pointed upper end; and, a removable sheath having a tubular body with a closed end and an open end for receiving said pointed upper end; and, a first plurality of apertures longitudinally disposed on said face portion at prescribed locations for removably receiving at least a pair of interchangeable rods and at least one interchangeable lance, further comprising:

at least one main lance aperture for removably receiving at least one of said plurality of interchangeable lances, each further comprising internal threading;

at least seven pairs of rod apertures for removably receiving said least one pair of interchangeable rods; and, at least two spool rod apertures for removably receiving at least one spool rod disposed adjacent to one of said side walls;

wherein each of said pairs of rod apertures is disposed at preferred increasing intervals of approximately one inch on either side of said main lance aperture;

wherein said at least one spool rod each comprises a circular cross section having a length and a diameter suited to fit in a center aperture of a bobbin of said continuous length of material;

wherein said main body further comprises:

a top portion, perpendicular with the face portion and extending longitudinally thereof, said top portion comprising a second plurality of apertures longitudinally disposed therein for removably receiving said plurality interchangeable rods, said plurality of lances, said spool rod, and said sheath when not in use;

a rear portion having a friction surface;

a bottom portion;

two side walls which define a thickness;

a plurality of width indicia each comprising numeric indicia disposed adjacent to each one of said at least seven pairs of rod apertures for indicating an insertion location of said at least one pair of interchangeable rods at an approximate width of said manufactured bow;

lance indicia comprising alphabetic indicia disposed adjacent to said at least one main lance aperture for indicating an insertion location thereof said at least one lance aperture;

start indicia comprising alphabetic indicia disposed adjacent to said at least one main lance aperture for indicating a position of a first tail of said manufactured bow;

finish indicia comprising alphabetic indicia disposed adjacent to said at least one main lance aperture for indicating a position of a second tail of said manufactured bow;

plurality of directional indicia comprising graphic indicia disposed in a figure-eight pattern having said at least one main lance aperture at a center thereof for indicating a winding direction for said continuous length of material around said at least one pair of interchangeable rods; and, spool indicia comprising alphabetic indicia disposed adjacent to said at least two spool rod apertures for indicating an insertion location of said at least one spool rod wherein said at least one interchangeable lance being positioned in a selected one of said first plurality of apertures extending upward from said face portion and each of said at least one pair of interchangeable rods being positioned in a selected one of said first plurality of apertures extending upward from said face portion.

2. The apparatus of claim 1, wherein said second plurality of apertures further comprises:

at least three pairs of rod storage apertures;

at least two lance storage apertures;

at least one sheath storage aperture; and, at least one spool rod storage aperture.

* * * * *